US007628606B1

(12) United States Patent
Browning

(10) Patent No.: US 7,628,606 B1
(45) Date of Patent: Dec. 8, 2009

(54) METHOD AND APPARATUS FOR COMBUSTING FUEL EMPLOYING VORTEX STABILIZATION

(76) Inventor: James A. Browning, 187 Stevens Rd., Lebanon, NH (US) 03766

( * ) Notice: Subject to any disclaimer, the term of this patent is extended or adjusted under 35 U.S.C. 154(b) by 0 days.

(21) Appl. No.: 12/146,538

(22) Filed: Jun. 26, 2008

Related U.S. Application Data

(60) Provisional application No. 61/054,245, filed on May 19, 2008.

(51) Int. Cl.
*F23N 1/02* (2006.01)

(52) U.S. Cl. ..... 431/12; 431/2

(58) Field of Classification Search ..... 431/9, 431/8, 187, 12, 2
See application file for complete search history.

(56) References Cited

U.S. PATENT DOCUMENTS 2,499,207 A * 2/1950 Wolfersperger ..... 431/10
2,787,318 A * 4/1957 Wolfersperger ..... 431/9
3,030,773 A * 4/1962 Johnson ..... 60/749
3,067,582 A * 12/1962 Schirmer ..... 60/39.821
3,070,317 A * 12/1962 Hunter et al. ..... 239/402
3,091,446 A * 5/1963 Smith ..... 432/20
3,404,939 A * 10/1968 Saha ..... 431/263
3,498,753 A * 3/1970 Koide et al. ..... 422/202
3,685,740 A * 8/1972 Shepherd ..... 239/400
3,726,634 A * 4/1973 Thomson et al. ..... 431/353
3,826,079 A * 7/1974 Quigg et al. ..... 60/776
3,836,315 A * 9/1974 Shular ..... 431/9
3,938,323 A * 2/1976 Quigg et al. ..... 60/748
3,955,361 A * 5/1976 Schirmer et al. ..... 60/736
4,120,639 A * 10/1978 Thekdi et al. ..... 431/158
4,127,387 A * 11/1978 Vanderveen et al. ..... 422/158
4,147,753 A * 4/1979 Endo et al. ..... 422/202
4,165,364 A * 8/1979 Dollinger et al. ..... 423/456
4,251,205 A * 2/1981 Roeder et al. ..... 431/263
4,278,494 A * 7/1981 Lilja et al. ..... 159/16.2
4,373,325 A * 2/1983 Shekleton ..... 60/776
4,470,262 A * 9/1984 Shekleton ..... 60/737
4,540,121 A 9/1985 Browning
4,544,394 A * 10/1985 Hnat ..... 65/27
4,586,443 A * 5/1986 Burge et al. ..... 110/347
4,639,215 A * 1/1987 Armstrong ..... 431/354
4,764,656 A * 8/1988 Browning ..... 219/121.44
4,828,487 A * 5/1989 Earl ..... 431/187
4,986,199 A * 1/1991 Komeno et al. ..... 110/347
5,230,878 A * 7/1993 Nakai et al. ..... 423/449.1
5,240,410 A * 8/1993 Yang et al. ..... 431/284
5,283,985 A * 2/1994 Browning ..... 451/38
5,449,286 A * 9/1995 Snyder et al. ..... 431/9
5,490,775 A * 2/1996 Joshi et al. ..... 431/187

(Continued)

*Primary Examiner*—Kenneth B Rinehart
*Assistant Examiner*—Jorge Pereiro
(74) *Attorney, Agent, or Firm*—James A. Browning

(57) ABSTRACT

The present method and apparatus for producing a supersonic jet stream introduce an oxidizer in such a manner as to create a vortex, which is then restricted. Fuel is introduced into a reduced pressure eye of the vortex, forming a stratified composite stream of gases with unmixed oxidizer surrounding an inner mixture of fuel and oxidizer. This stratified composite stream is passed down a tube that exhausts to a low pressure environment. The combined fuel and oxidizer in the stratified stream is ignited to provide a high-velocity stream of combustion products. The outer layer of unmixed oxidizer in the vortex shields the tube and reduces or eliminates the need for additional cooling.

1 Claim, 7 Drawing Sheets

U.S. PATENT DOCUMENTS 5,531,590 A 7/1996 Browning
5,547,368 A * 8/1996 Slavejkov et al. ..... 431/8
5,593,301 A * 1/1997 Garrison et al. ..... 431/350
5,649,325 A * 7/1997 Garrison et al. ..... 588/320
5,762,007 A * 6/1998 Vatsky ..... 110/264
5,944,507 A * 8/1999 Feldermann ..... 431/189
5,960,026 A * 9/1999 Nolting et al. ..... 373/24
6,068,470 A * 5/2000 Zarzalis et al. ..... 431/187
6,126,438 A * 10/2000 Joshi et al. ..... 431/161
6,126,439 A * 10/2000 Knopfel et al. ..... 431/350
6,145,450 A * 11/2000 Vatsky ..... 110/265
6,201,029 B1 * 3/2001 Waycuilis ..... 518/703
6,752,620 B2 * 6/2004 Heier et al. ..... 431/8
6,986,473 B2 * 1/2006 Jansohn et al. ..... 239/398
2003/0143502 A1 * 7/2003 Heier et al. ..... 431/8

* cited by examiner

-Prior Art-

METHOD AND APPARATUS FOR COMBUSTING FUEL EMPLOYING VORTEX STABILIZATION

FIELD OF THE INVENTION

The present invention relates to a method and apparatus for combusting fuel with an oxidizer to obtain a high velocity jet of hot combustion gases, having particular utility for providing a thermal torch.

BACKGROUND OF THE INVENTION

In a classical combustion apparatus for producing a high-velocity flame jet, a fuel and an oxidizer are combined in a combustion chamber. The combined fuel and oxidizer are then ignited to produce combustion gases, and these gases are then accelerated through a nozzle. FIG. 1 is a cross-section view that illustrates a typical example of a conventional combustion device 10, having a housing 11 containing a combustion chamber 12. The combustion chamber 12 communicates with a nozzle 13 and an exit passage 14. An oxidizer, usually gaseous oxygen, is introduced into the combustion chamber 12 through an oxidizer orifice 15. Fuel, either liquid or gas, enters the combustion chamber 12 through a fuel inlet 16 to mix with the oxidizer flow from the oxidizer orifice 15. Ignition, often provided by a spark-plug (not shown), occurs to form an intense flame in the combustion chamber 12. The width and length of the combustion chamber 12 are sized to provide essentially complete combustion of the fuel and oxidizer. Prior to entry into the nozzle 13, the velocity of the hot combustion products is quite low. The combination of a restricting cross section of the nozzle 13 with an expanding cross section of the exit passage 14 serves to greatly accelerate the combustion gasses. This structure is termed a de Laval nozzle.

Due to the extreme heat generated in the combustion device 10, external cooling is required. An outer shell structure 20 is spaced a small distance away from the housing 11, forming an annular coolant passage 21. Water passes into the annular coolant passage 21 through a coolant inlet 22, exiting through a coolant outlet 23. The requirement for water cooling complicates the structure and reduces thermal efficiency, since much of the energy generated by combustion is lost in the form of heat.

SUMMARY OF THE INVENTION

The method of the present invention for producing a supersonic jet stream includes the step of creating a vortex of an oxidizing fluid having an eye with a reduced pressure. The vortex is constricted and fuel is passed into the eye of the vortex to form a stratified composite stream, with unmixed oxidizer surrounding an inner mixture of fuel and oxidizer. This stratified composite stream is passed down a tube having a bore that exhausts to a low pressure environment. The combined fuel and oxidizer in the stratified stream are ignited to provide a stream of combustion products which can reach velocities exceeding the speed of sound.

While the method has general applicability, it can be conveniently practiced with a combustion and accelerator apparatus described hereafter which constitutes part of the invention. In general, the apparatus is configured such that it merges and expands a fuel stream and an oxidizer stream and forms a vortex-stabilized composite stream having a fuel-rich core surrounded by an outer sheath of the oxidizer, with the combined fuel and oxidizer in the fuel-rich core providing an intermediate combustible mixture that, when ignited, expands to provide a flame-stabilized high velocity jet.

The apparatus has a housing which terminates in a proximal end and a distal end. The housing has a cavity which is symmetrically disposed about a central axis. The cavity has a central section which is generally cylindrical and nozzle section which extends to the distal end.

A fuel passage is provided in the housing and passes through the proximal end of the housing and into the cavity. The fuel passage is so positioned such that it directs the fuel along the central axis.

A tube having a bore attaches to the housing at the distal end of the housing, forming a continuation of the housing and terminating with a free end. The bore is symmetrically disposed about the central axis. The length of the tube is adjusted such that the oxidizer flow shrouds the wall of the tube extension along its entire length, assuring that it remains cool.

A fuel passage extender extends into the central section of the cavity and preferably terminates in the nozzle section or in the bore of the tube. It is preferred that the fuel passage extender be a tapered structure having a cross section which, at least over a substantial portion of its length, reduces as a function of its distance from the proximal end of the housing.

The combustion apparatus is provided with a means for injecting the oxidizer into the central section of the cavity so as to create a vortex in the central section having a low pressure eye centered on the central axis. The nozzle section serves to constrict the vortex as it advances through the housing.

This means for injecting the oxidizer can be provided by employing one or more oxidizer passages that terminate in the central section of the cavity, each of the oxidizer passages being substantially tangent to a circle centered on the central axis and residing substantially in a plane normal to the central axis. By so introducing the oxidizer, a vortex will be created in the central section of the cavity.

The vortex passes through the nozzle section and into the bore and, at some point along this portion of the path, the fuel is released into the eye of the vortex in a manner such that the fuel remains directed along the central axis as it passes along the bore of the tube, thus providing a vortex-stabilized stratified fuel and oxidizer stream which remains stratified as the oxidizer and fuel flow through the remainder of the structure.

In some embodiments, the cross section of the bore increases as the distance from the distal end of the housing increases. This increase can be a continuous function of the distance or can be a stepwise increase.

DETAILED DESCRIPTION OF THE PREFERRED EMBODIMENTS

Figure 1:
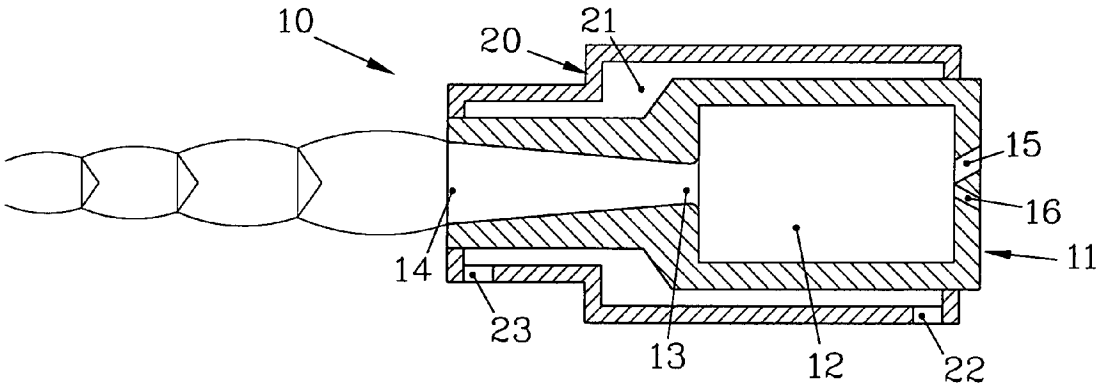
FIG. 1 is a section view of a prior art combustion apparatus, which is a chamber-stabilized torch suitable for depositing a layer of material on a target.
Figure 2:
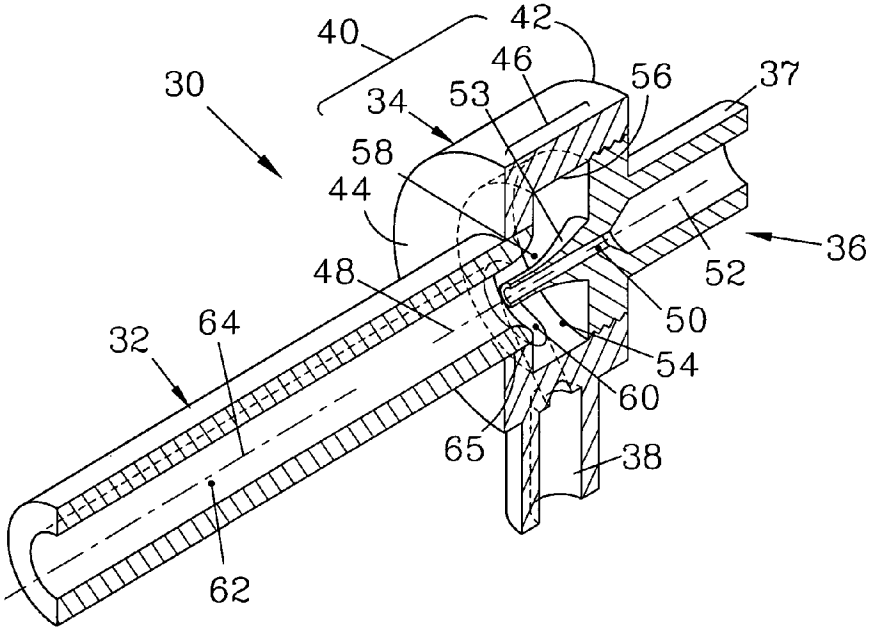
FIG. 2 is an isometric section view of a combustion apparatus that forms one embodiment of the present invention, which employs a single oxidizer injection passage to provide a vortex-stabilized stratified fuel and oxidizer stream.
Figure 3:
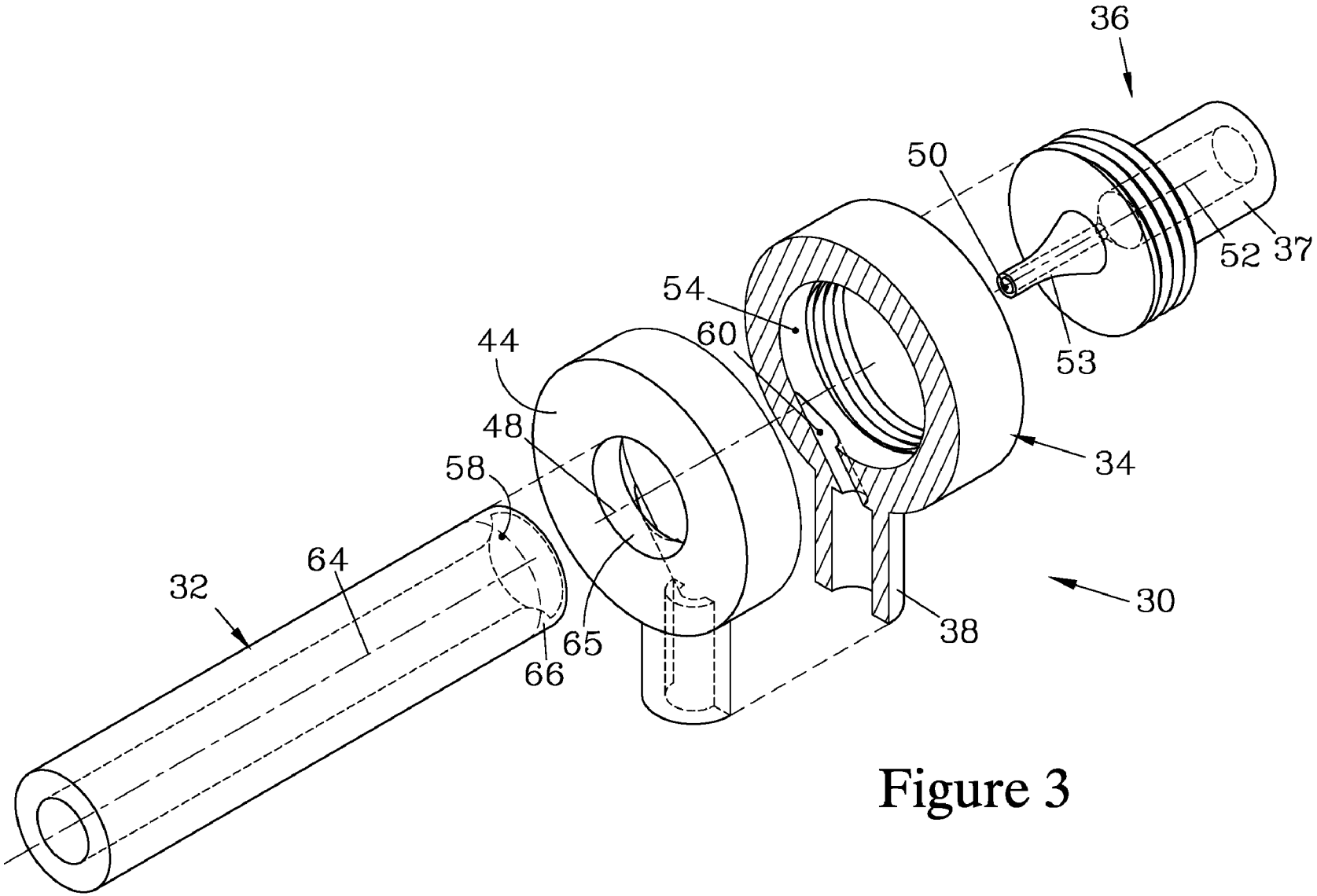
FIG. 3 is an exploded isometric view of the embodiment shown in FIG. 2, with a portion of a housing sectioned to better show the oxidizer injection passage.

FIG. 2 illustrates one embodiment of the present invention, a combustion apparatus 30. FIG. 3 shows an exploded view of the same embodiment. This combustion apparatus 30 can be fabricated from three pieces of stock. A tube 32 is attached to a body section 34 which in turn attaches to a backing section 36. The backing section 36 in turn has a fuel coupling 37 for connection to a conventional fuel supply line (not shown). The tube 32 is preferably of high conductivity copper to provide greater heat transfer, while the body section 34 and the backing section 36 can be formed of brass. The body section 34 also attaches to an oxidizer coupling 38 for connection to a conventional oxidizer supply line (not shown).

While the structure of the combustion apparatus 30 can be defined in terms of the pieces from which it can be fabricated, it is more convenient to discuss the structure in terms of the functional elements which provide certain functions on the oxidizer stream and the fuel stream as they pass through the combustion apparatus 30.

The combustion apparatus 30 has a housing 40 that terminates at a proximal end 42 and a distal end 44. The housing 40 has a cavity 46 symmetrically disposed about a central axis 48. The cavity 46 is terminated in part by the proximal end 42, defined by the backing section 36 which has a central fuel injection passage 50 therethrough which communicates with the fuel coupling 37. The fuel injection passage 50 has a fuel passage axis 52 which coincides with the central axis 48. The backing section 36 is provided with a fuel passage extension 53 which continues the fuel injection passage 50 into the cavity 46. The cavity 46 has two sections, a central section 54 which is generally cylindrical, being radially terminated by a peripheral wall 56 that is a cylindrical surface symmetrically disposed about the central axis 48, and a nozzle section 58 which connects the central section 54 to the distal end 44.

An oxidizer injection passage 60 is provided to inject an oxidizer from the oxidizer coupling 38 into the central section 54 of the cavity 46. The oxidizer injection passage 60 is configured to direct the oxidizer into the central section 54 in a tangential manner so as to generate a vortex centered on the central axis 48, the vortex subsequently passing through the nozzle section 58 and into a bore 62 of the tube 32.

The bore 62 of the tube 32 is symmetrical about a bore axis 64, and the tube 32 is attached to the housing 40 such that the bore axis 64 aligns with the central axis 48 of the cavity 46 and with the fuel passage axis 52. The joinder of the tube 32 with the housing 40 can be made by a variety of techniques. As depicted in FIGS. 2 and 3, the housing 40 of this embodiment is provided with an opening 65 in the distal end 44 which slidably accepts an insertable section 66 of the tube 32. The insertable section 66 of the tube 32 has the bore 62 reshaped over the region thereof that is adjacent to the central section 54 of the cavity 46 when the tube 32 is properly inserted into the opening 65, this shaping of the bore 62 forming the nozzle section 58 of the cavity 46. The tube 32 in this embodiment is secured to the housing 40 by soldering or other appropriate joining technique.

Figure 4:
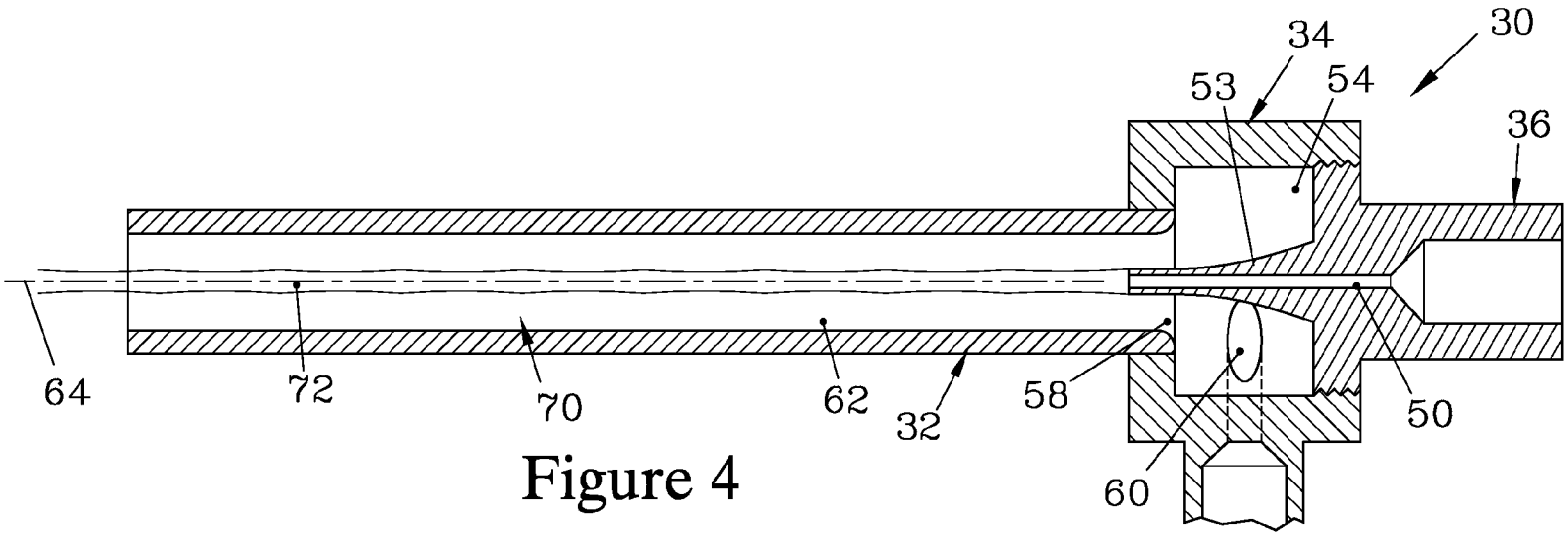
FIG. 4 is an enlarged cross section of the embodiment shown in FIGS. 2 and 3 better showing the action of fuel and oxidizer within a tube which forms part of the combustion apparatus shown in FIG. 2. The tube is illustrated with a schematic representation of a stratified stream of fuel and oxidizer passing through and exiting a bore of the tube.
Figure 5:
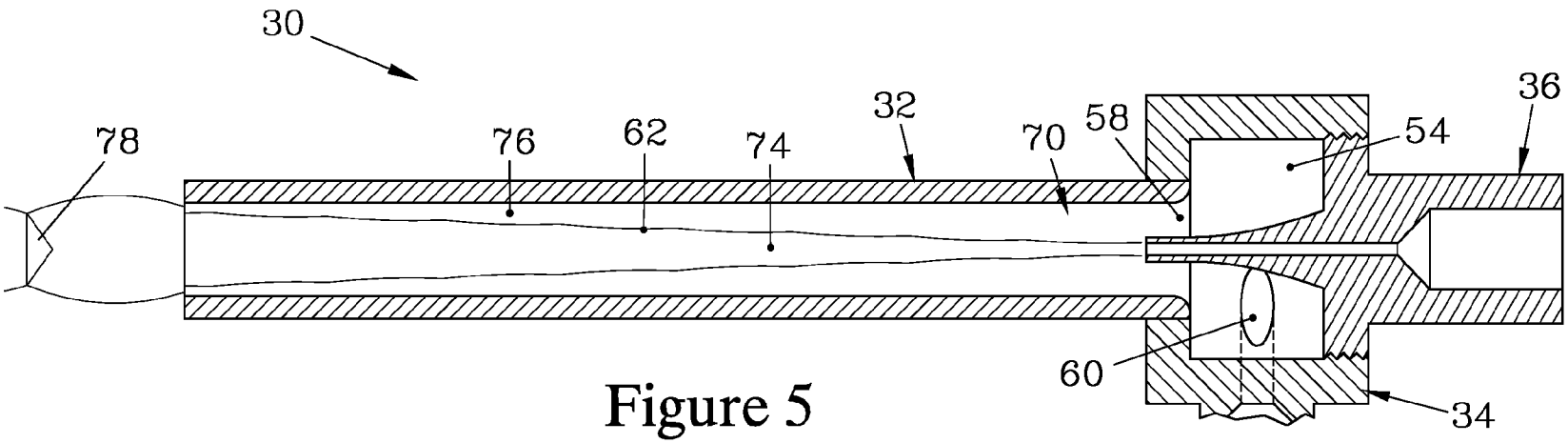
FIG. 5 is a cross section view of the combustion apparatus shown in FIG. 4 after the composite stream in the tube has been ignited.

FIGS. 4 and 5 are sectional side views of the combustion apparatus 30 shown in FIGS. 2 and 3, to better illustrate one preferred spacial relationship between the fuel passage extension 53 and the bore 62 of the tube 32. In this embodiment the fuel passage extension 53 continues beyond the nozzle section 58 into the bore 62. FIG. 4 illustrates the combustion apparatus 30 in an initial startup condition where the oxidizer is being provided to the combustion apparatus 30 and has established a vortex, schematically represented by 70, having a low pressure core 72 or eye of the vortex 70 which is centered on the bore axis 64.

FIG. 5 illustrates the combustion apparatus 30 after fuel is being directed into the low pressure core 72 and is ignited to form a combustion region 74 that increases in cross section as the fuel passes down the bore 62. The limit of the expansion will be determined by the length of the tube 32, and should be maintained such that an unmixed sheath region 76 of the oxidizer surrounds the combustion region 74 throughout the length of the bore 62 to buffer the tube 32 from the heat generated by the combustion and to enhance the efficiency of the combustion apparatus 30, since loss of thermal energy is reduced. Having the combustion apparatus 30 so operated results in greater acceleration of the combustion products. In fact, the output from combustion apparatus 30 exhibits shock diamonds 78, indicating that the output stream has reached supersonic flow. The unmixed sheath region 76 results from operating the combustion apparatus 30 in such a manner that the radial advancement of flame in the combustion region 74 as it passes through the bore 62 is greater than the rate of diffusion of the unburned fuel radially outward into the oxidizer. It should be noted that the formation of the low pressure core 72 allows the combined fuel and oxidizer to be ignited after exiting the bore 62, in which case the flame rapidly progresses upstream to form the combustion region 74 within the bore 62. Alternatively, the combined fuel and oxidizer could be ignited within the bore 62, such as by a spark plug (not shown).

Figures 6, 7:
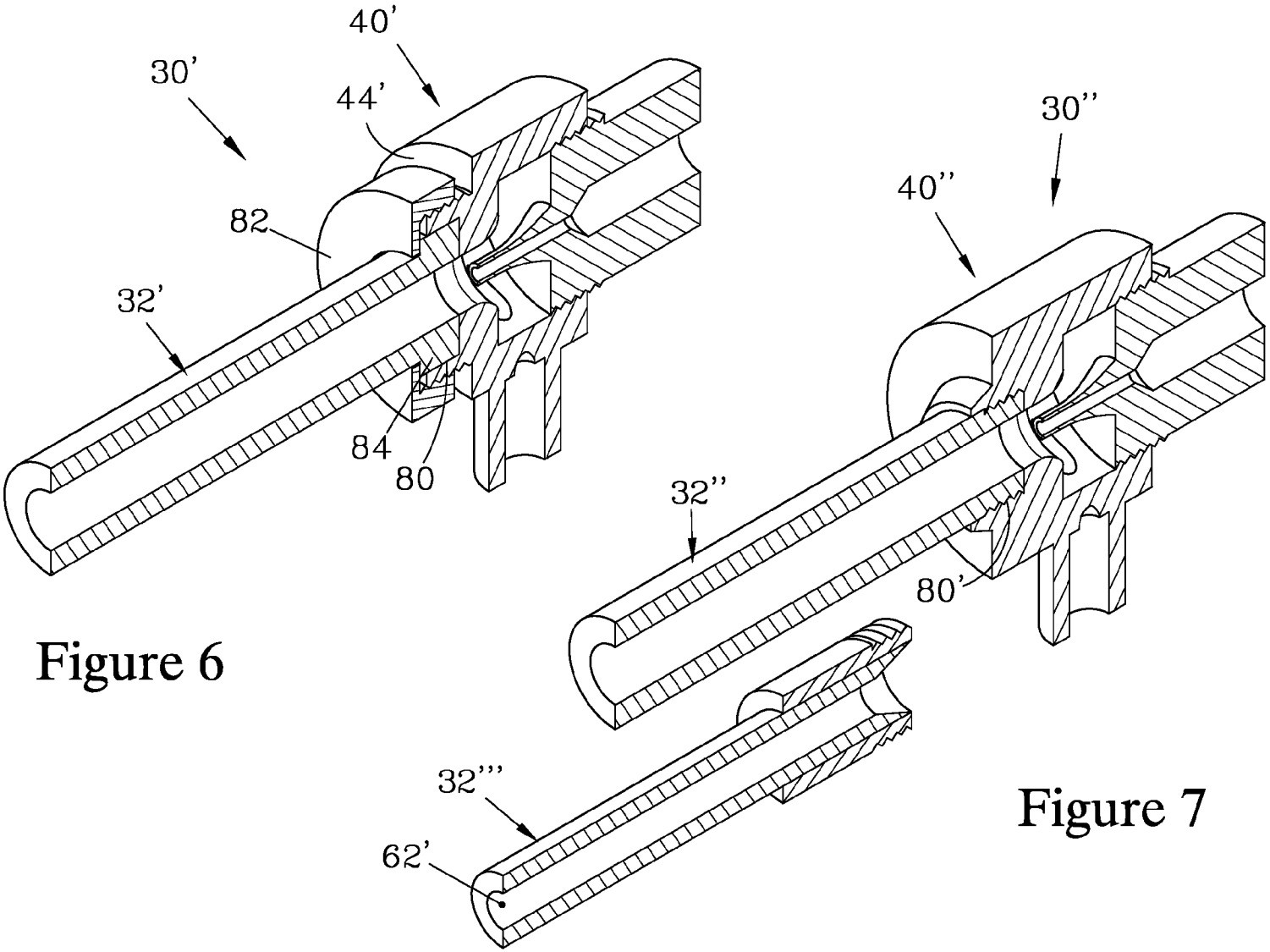
FIG. 6 is an isometric section view of a combustion apparatus which is functionally similar to that shown in FIGS. 2-5, but where the tube can be readily replaced. The tube has an enlarged segment that slidably engages a socket in a housing of the combustion apparatus, and a retention collar threadably engages the housing to secure the tube in the socket.
FIG. 7 is an isometric section view of another combustion apparatus that allows the tube to be readily replaced. In this embodiment, the housing has a socket that is threaded and the tube has threads that engage the threads of the socket to attach the tube to the housing. An alternative tube having a smaller bore is also illustrated, which can be interchanged with the first tube to allow the bore size to be varied to suit the desired operating parameters for the combustion apparatus.

FIGS. 6 and 7 each illustrate an alternative embodiments of combustion apparatus (30' and 30", respectively) which each has a replaceable tube (32' and 32"), but which is each functionally the same as the combustion apparatus 30 discussed above and shown in FIGS. 2-5. In the case of the combustion apparatus 30' shown in FIG. 6, the tube 32' fits into a socket 80 which extends the distal end 44' of the housing 40'. A retention collar 82 threadably engages the distal end 44' and forcibly engages an enlarged segment 84 of the tube 32' to lock the tube 32' in the socket 80.

In the combustion apparatus 30" shown in FIG. 7, the tube 32" threads directly into the socket 80' of the housing 40". FIG. 7 also illustrates an alternate tube 32'" that could be exchanged for the tube 32" to provide a smaller bore 62'.

Figure 8:
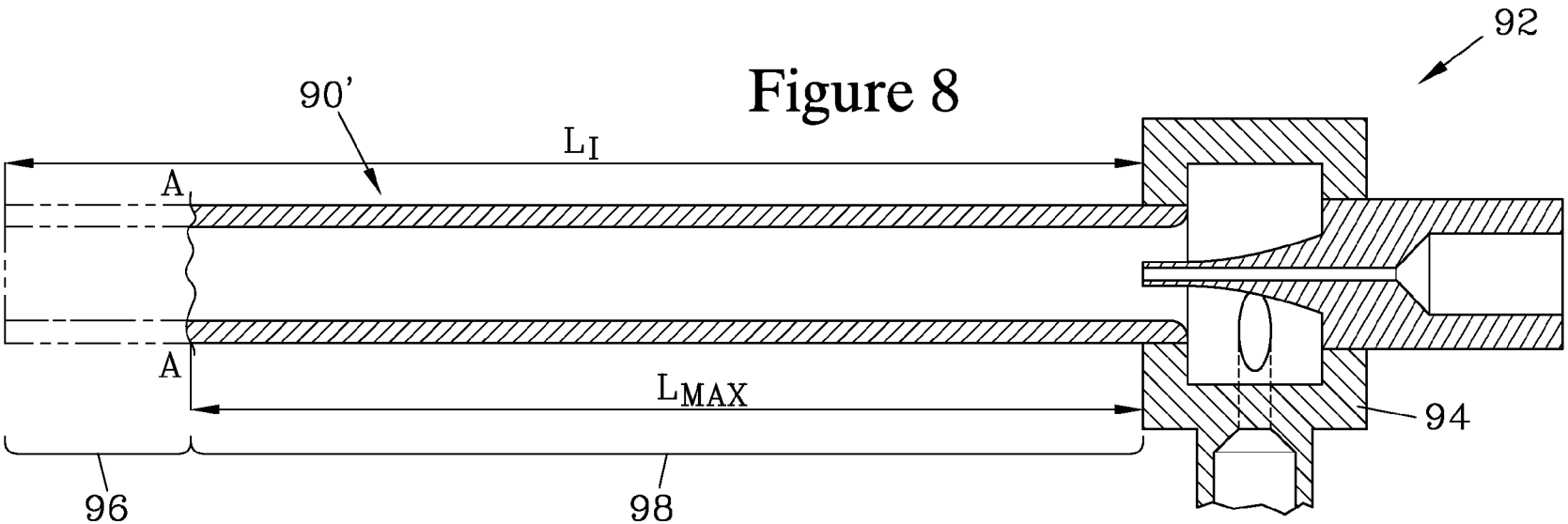
FIGS. 8 and 9 are section views that schematically illustrate one method for experimentally determining an appropriate length of a tube for a combustion apparatus such as those shown in FIGS. 2-7. In this method, a tube blank that is longer than the anticipated tube length is employed and is operated in a combustion apparatus under the desired operating conditions. The tube blank melts off at a point which indicates the maximum practical length, and the tube is then made somewhat shorter than this maximum practical length.
Figure 9:
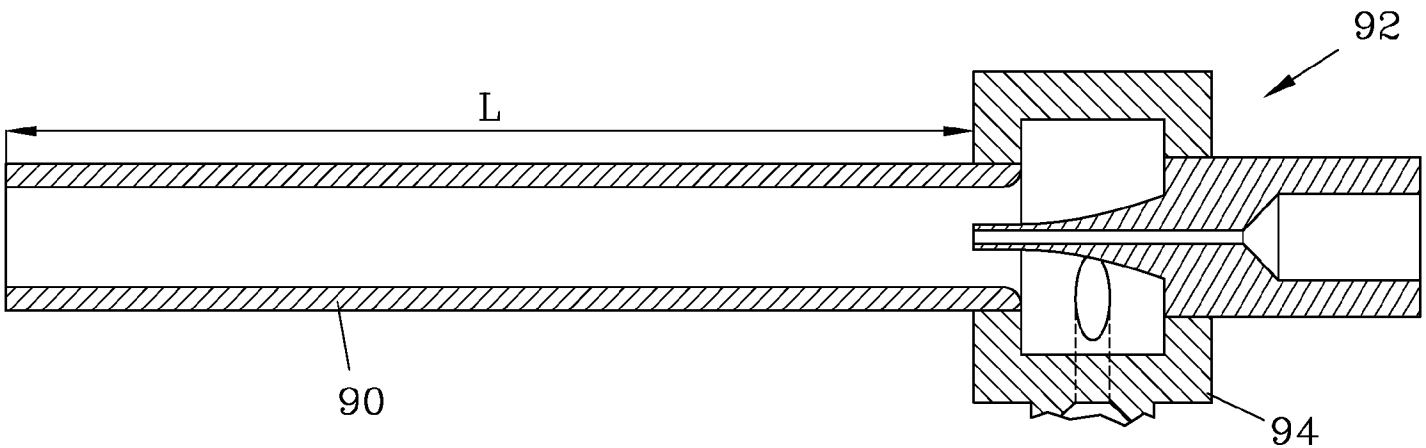

FIGS. 8 and 9 illustrate an experimental approach for determining an appropriate length L of a tube 90 for a combustion apparatus 92 having a structure similar to that of the combustion apparatus 30 discussed above. The combustion apparatus 92 also has a housing 94 to which the tube 90 is affixed. For a particular set of operating parameters, a maximum practical length $L_{MAX}$ for the tube 90 can be determined experimentally. To do this, a tube blank 90' having an initial length $L_I$ which is substantially longer than the final length L is attached to the housing 94 and fuel and oxidizer are introduced into the combustion apparatus 92 according to the desired operating parameters. When the combined fuel and oxidizer is ignited and burns, the combustion gases expand as they progress down the tube blank 90', and at some point expand so as to be close enough to the tube blank 90' that the sheath of cool oxidizer is no longer sufficient to prevent substantial heating of the tube blank 90'. At some point along the length of the tube blank 90', indicated by the line A-A, the heat from the combustion gases causes a terminal portion 96 (shown in phantom) of the tube blank 90' extending beyond the line A-A to melt, leaving a base portion 98 of the tube blank 90' remaining. The length of the base portion 98 extending to the line A-A defines the maximum practical length $L_{MAX}$ for the particular operating conditions employed. The length L of the tube 90 is then selected to be somewhat shorter than the maximum practical length $L_{MAX}$.

Figures 10, 11:
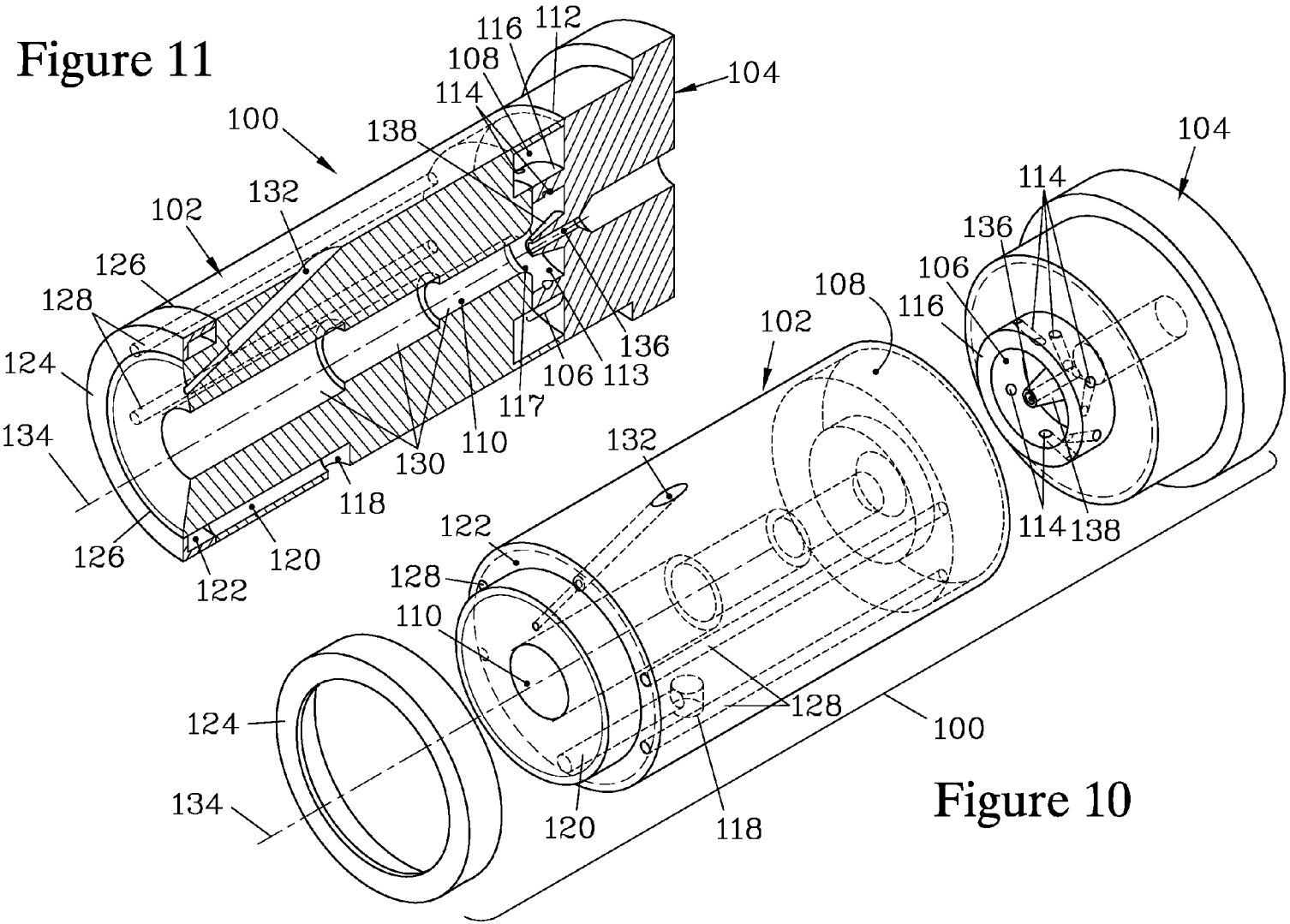
FIG. 10 is a partially exploded isometric view of a combustion apparatus that forms another embodiment of the present invention, where the housing and the extension are formed as an integral unit and the oxidizer is preheated by passing it through the wall of the extension. In this embodiment, the oxidizer is injected into a central section of a cavity via a plurality of oxidizer passages that communicate between an oxidizer manifold and the central section. The tube of this embodiment has a bore with a stepped profile so as to enhance the acceleration of the combusting gases and reduce noise.
FIG. 11 is a sectioned view of the embodiment shown in FIG. 10 when assembled.

While all the embodiments discussed above have a single oxidizer passage for introduction of the oxidizer into the cavity so as to form a vortex that travels through the chamber, in some instances it is preferred to employ multiple passages to introduce the oxidizer into the chamber. In such cases, it is frequently advantageous to provide an annular manifold for the oxidizer, this manifold encircling the at least a portion of the cavity and serving as the connector between the oxidizer source and the passages. FIGS. 10 and 11 illustrate a combustion apparatus 100 that forms one embodiment of the present invention that employs such an oxidizer manifold.

The combustion apparatus 100 again is designed to swirl the oxidizer as it is introduced; however, in this embodiment the oxidizer is introduced into the cavity through multiple passages. The combustion apparatus 100 has a structure with only three parts, each of which is designed to be readily fabricated by machining.

The combustion apparatus 100 has a main body 102 and a proximal body 104 which, in combination, form a housing with a cavity 106. In this embodiment, the cavity 106 is surrounded by an oxidizer manifold 108. The main body 102 also serves as a tube, having a bore 110 therethrough which communicates with the cavity 106. The main body 102 and the proximal body 104 are attached together at a single body joint 112, which can be sealed by soldering to seal the oxidizer manifold 108. While there is no sealed joint between the cavity 106 and the oxidizer manifold 108, the effect of any oxidizer leakage through this joint should be negligible.

The oxidizer manifold 108 introduces oxidizer into a central section 113 of the cavity 106 via a series of tangentially-directed oxidizer passages 114 passing through a wall 116 that defines the periphery of the central section 113, forming a vortex that is then constricted by passing through a nozzle 117.

The oxidizer is introduced into the oxidizer manifold 108 from an oxidizer inlet 118 through a series of passages which run alongside the bore 110. The oxidizer inlet 118 can connect to an oxidizer coupling such as that shown in FIGS. 2 and 3. From the oxidizer inlet 118, the oxidizer is first passed forward by a forward conduit 120 to a forward annular space 122. The forward annular space 122 is formed by a forward ring 124 that is sealably attached to the main body 102 at two forward ring joints 126; again, these joints 126 can be soldered. The forward annular space 122 circumscribes the bore 110.

From the forward annular space 122, the oxidizer is passed rearward to the oxidizer manifold 108 through a number of side conduits 128 that extend through the main body 102 parallel to the bore 110. The side conduits 128 communicate between the forward annular space 122 and the oxidizer manifold 108.

In the combustion apparatus 100, the bore 110 expands in cross section as the distance from the cavity 106 increases. Such could be provided by a gradually expanding cross section; however, for ease of machining the embodiment illustrated, the bore 110 is expanded by forming a series of bore cylindrical sections 130, where the diameter of each of the bore cylindrical sections 130 increases as the distance of the bore cylindrical section 130 from the cavity 106 increases.

When the combustion apparatus 100 is to be employed to apply a coating, means are provided for introducing a coating material into the stream of combustion gases. In the embodiment illustrated, such means are provided by a wire-guiding passage 132 extending through the main body 102. The wire-guiding passage 132 is inclined with respect to a central axis 134, about which the cavity 106 and the bore 110 are symmetrically disposed. The wire-guiding passage serves to direct a wire (not shown) passed therethrough such that the wire will intersect the stream of combustion gases exiting from the bore 110. The hot combustion gases can then melt the end of the wire to introduce molten droplets of the coating material into the stream of gases, which then accelerates these droplets to impact against a workpiece to be coated.

An alternative approach to introducing a coating material would be to introduce a powder into the stream of fuel which is introduced into the cavity 106 through a fuel passage 136 that extends through the proximal body 104 and is aligned with the central axis 134. In the combustion apparatus 100, introducing powder into the oxidizer stream would be impractical in view of the number of passages and spaces (120, 122, 128, 108, and 114) through which the oxidizer passes before reaching the cavity 106. In any case, it is preferred for the fuel passage 136 to be extended into the cavity 106 by a fuel passage extender 138.

The above examples have been for combustion apparatus embodiments that do not employ water cooling, and hence limit the length of the tube in which the combustion occurs to assure that a layer of unmixed oxidizer resides against the tube along its length, this layer serving to protect the tube from the heat of the combustion gasses. The length of the tube can be increased if the tube is water-cooled. The water cooling can be accomplished by employing a water jacket and/or by injecting water into the vortex of the oxidizer, as discussed below.

Figures 12, 13:
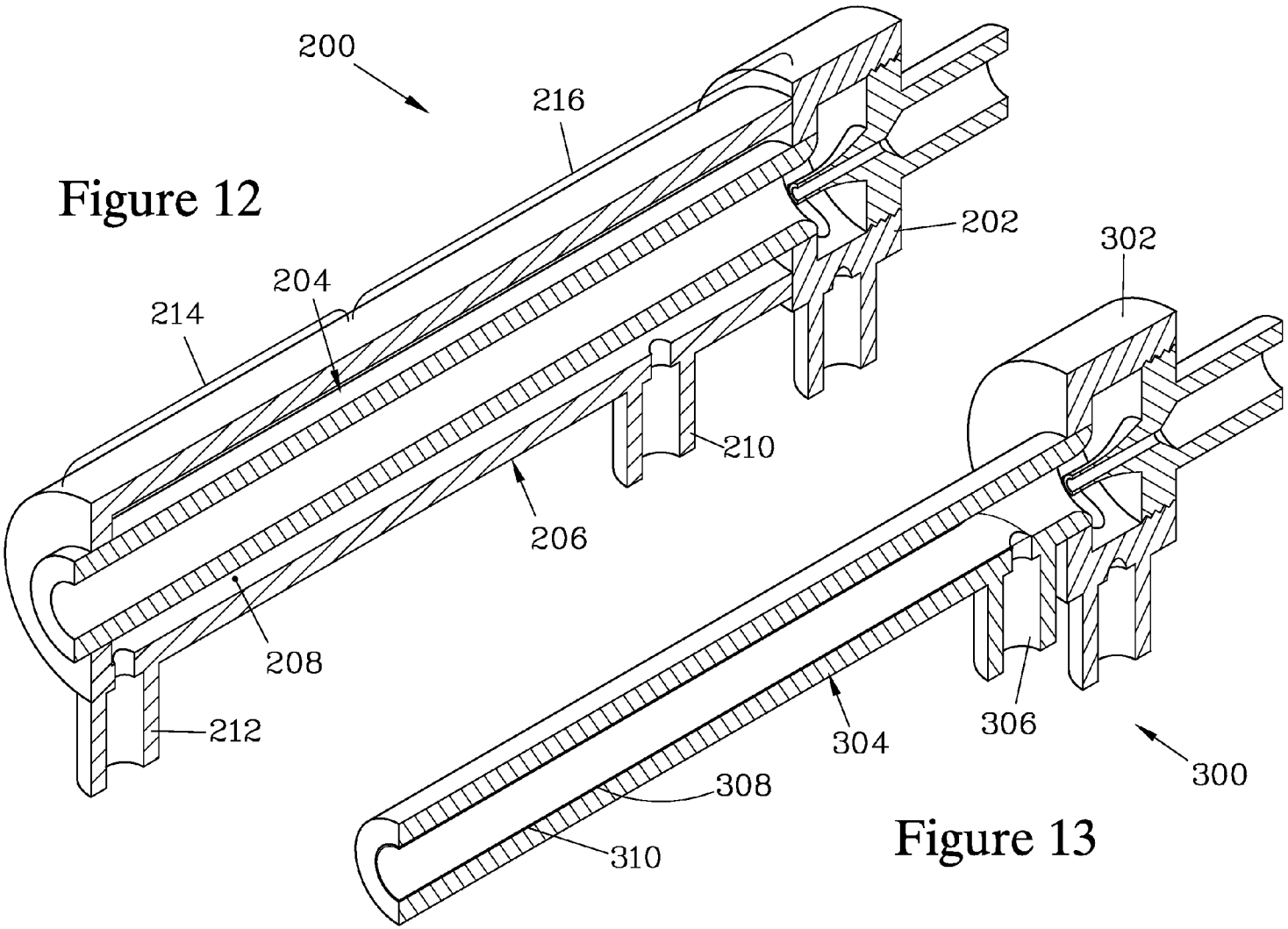
FIG. 12 is a section view of another embodiment, which is similar to that shown in FIGS. 2-5 but where a water-cooling jacket is provided around the tube to allow the use of a longer tube.
FIG. 13 is a section view of another embodiment that uses water cooling, but where the water is introduced into the vortex of uncombined oxidizer.

FIG. 12 illustrates a combustion apparatus 200 which has a housing 202 and a tube 204 attached thereto. The tube 204 is encased in a water cooling jacket 206 which provides an annular water passage 208 around the tube 204. The jacket 206 is provided with a water inlet 210, into which cooling water is introduced, and a water outlet 212 where the water exits the jacket 206. The water is heated as it passes along a terminal portion 214 of the tube 204, the terminal portion 214 being the portion which is beyond a self-cooling section 216 of the tube 204 where the tube 204 is cooled by the oxidizer. Thus, the heat input that is extracted by the water is substantially less than the heat extracted by water jacket of the prior art, since much of the tube 204 is shielded by the vortex of the oxidizer, and therefore most of the heat generated by the burning remains in the combustion products as they pass down the tube 204.

FIG. 13 illustrates another combustion apparatus 300 which has a housing 302 and a tube 304 attached thereto. In this embodiment, a water inlet 306 is provided which allows water to be injected into a vortex that is formed by the oxidizer as it passes down the tube 304. The water introduced into the vortex is spun to a bore surface 308 of the tube 304, since the water is more dense than that oxidizer; this spun water forms a water film 310 on the bore surface 308. As the combustion products expand radially, the oxidizer is exhausted and the water film 310 initially provides shielding over the additional length and, for this additional length, provides shielding of the tube 304. By adjusting the flow of the water into the tube 304, one can adjust the water flow such that a dry output will be provided without overheating of the tube 304. This technique has an additional benefit in that it changes the character of the output combustion products and maintains a less oxidizing output. In fact, one can obtain the desired flow by monitoring the color of the output of the torch while adjusting the input water flow.

While the novel features of the present invention have been described in terms of particular embodiments and preferred applications, it should be appreciated by one skilled in the art that substitution of materials and modification of details can be made without departing from the spirit of the invention.

What I claim is:

1. A method producing a supersonic flame jet stream for use in heating and propulsion applications, said method comprising the steps of creating an intense vortex of essentially pure liquid or gaseous oxygen within and through a constricting bore of a length at least six times that of its diameter, the vortex possessing a sub-atmospheric pressure eye positioned centrally through the bore;

passing a gaseous fuel axially into the eye of the continuously constricted vortex flow to form a stratified composite stream;

igniting the stratified composite stream to produce nearly complete combustion of the oxygen and fuel prior to their exiting said extended bore, said stratified flow is forced by a high pressure drop during its acceleration to the atmosphere to produce the axially-aligned supersonic jet stream beyond the exit of the bore;

and, limiting the length of said constricting bore to that maximum length which maintains an annular thin sheath of cold oxygen completely surrounding the exiting jet to prevent over-heating the material containing said bore.

* * * * *